US011213704B2

(12) United States Patent
Smith

(10) Patent No.: US 11,213,704 B2
(45) Date of Patent: Jan. 4, 2022

(54) SAFETY TIE OFF DEVICE

(71) Applicant: Gerry Smith, Weirsdale, FL (US)

(72) Inventor: Gerry Smith, Weirsdale, FL (US)

( * ) Notice: Subject to any disclaimer, the term of this patent is extended or adjusted under 35 U.S.C. 154(b) by 320 days.

(21) Appl. No.: 16/416,160

(22) Filed: May 18, 2019

(65) Prior Publication Data

US 2019/0366134 A1 Dec. 5, 2019

Related U.S. Application Data

(60) Provisional application No. 62/680,704, filed on Jun. 5, 2018.

(51) Int. Cl.
*A62B 35/00* (2006.01)
*E04G 21/32* (2006.01)

(52) U.S. Cl.
CPC ..... *A62B 35/0068* (2013.01); *E04G 21/3214* (2013.01)

(58) Field of Classification Search
CPC ..... A62B 35/0068; E04G 21/3214
See application file for complete search history.

(56) References Cited

U.S. PATENT DOCUMENTS 4,044,987 A * 8/1977 Tausanovitch ..... E04G 17/0652 249/219.2
6,298,629 B1 * 10/2001 Ador ..... A62B 35/005 182/3
8,607,515 B2 * 12/2013 Jarvis ..... E04B 1/4128 52/253
2006/0218710 A1 * 10/2006 Furukawa ..... A47K 13/12 4/237
2017/0047881 A1 * 2/2017 Shimura ..... H02P 29/50
2017/0157438 A1 * 6/2017 Sargent ..... A62B 35/0068

FOREIGN PATENT DOCUMENTS

CA 2322921 C * 7/2005 ..... A62B 35/0068
DE 202011108340 U1 * 2/2012 ..... A62B 35/0068

* cited by examiner

*Primary Examiner* — Alvin C Chin-Shue
(74) *Attorney, Agent, or Firm* — Mitchell J. Mehlman, Esq.

(57) ABSTRACT

A safety tie off device for use on roof or canopy structures includes a plate. The plate has a spacer bar and an anchor protruding substantially perpendicular to the plate. A locking assembly includes a knob or handle attached to a threaded rod, a locking plate, and a fastener connected to the locking plate. The device is configured to attach to a roof structure, thereby forming a detachable, stable safety tie off device for a user to anchor a safety harness.

9 Claims, 8 Drawing Sheets

SAFETY TIE OFF DEVICE

CROSS-REFERENCE TO RELATED APPLICATION

This application claims priority of U.S. Provisional Application Ser. No. 62/680,704, entitled "SAFETY TIE OFF DEVICE", filed Jun. 5, 2018, the disclosure of which is incorporated herein by reference in its entirety.

FIELD OF THE INVENTION

The present invention relates generally to devices used for safety when working on a roof or other structure that presents a risk of fall and potential injury to the worker. In particular, the invention relates to devices which operate to satisfy safety requirements as tie-off anchor points for personal fall arrest systems such as safety harnesses.

SUMMARY

The invention comprises apparatus and method for removably mounting safety tie off devices, such that required safety harnesses can be anchored without either presenting additional safety hazards to workers on a roof top or causing any damage to the integrity of the roof structure.

In some embodiments, a device is fixedly mounted onto the structure of the roof. The device includes one or more tie-off anchors for a safety line that can be attached to the device.

In one embodiment, designed for 6" deck and 6" (low, high and super high) cap aluminum roof deck system, the anchor straddles the cap so that device be tightened under the ear of a pan on each side of the cap. This system utilizes two deck panels and one cap as a structural unit to carry the load for the anchor.

In another embodiment, designed for 3" and larger aluminum soffit pan roof systems, the anchor straddles a male and female lock wherein the device is tightened. This embodiment utilizes two soffit pans as a structural unit to carry the load for the anchor.

In some embodiments, the devices can include a full body harness in conjunction with a lanyard or retractable reel attached to the anchor. The structure may include or be manufactured from structural materials having physical and chemical properties to withstand the loads required including a sufficient margin of safety while also being able to withstand exposure to the elements without degradation.

In one aspect of the instant invention, the safety tie off device includes a plate. The plate has at least one spacer bar attached thereto. An anchor is connected to the plate and protrudes substantially perpendicular to the plate. A locking assembly includes at least one knob. The at least one knob is connected to a threaded rod. The threaded rod engages a threaded fastener. The threaded fastener is connected to a locking plate. The device is configured to attach to a cap and deck structure, thereby forming a detachable stable safety tie off device.

In some embodiments, the anchor includes a circular aperture.

In certain embodiments, the at least one knob is star shaped.

In other embodiments, the cap and deck structure includes an ear.

In some embodiments, the at least one knob is four knobs.

In yet other embodiments, the at least one spacer bar is two spacer bars.

In some embodiments, the device further includes at least one slide plate. The at least one slide plate has at least one elongated aperture therein.

In some embodiments, the device includes two slide plates. Each of the two slide plates has two elongated apertures therein.

In certain embodiments, the locking assembly includes four knobs. Each of the four knobs is connected to a first, a second, a third, and a fourth threaded rod, respectively. Each threaded rod engaging a first, a second, a third and a fourth threaded fastener, respectively. The first and second threaded fastener are connected to a first locking plate. The third and fourth threaded fastener are connected to a second locking plate.

In some embodiments, the device can further include a safety harness worn by a user. The safety harness has a lanyard and a terminal attachment means for connecting to the anchor.

In another aspect of the present invention, a safety tie off device has a first clamping plate and a second clamping plate connected by a hinge. The hinge includes a hinge rod. The first and second clamping plates each include an aperture therethrough, and each of the plates has first and a second spacer plate for engaging a vertical wall of a soffit pan. The hinge rod is configured form an anchor. A locking mechanism includes a handle, a threaded rod, and a retaining nut. The threaded rod protrudes thorough the aperture in each of the first and second clamping plates. The device is configured to attach to soffit pan structure thereby forming a detachable, stable safety tie off device.

In some embodiments, the hinge rod is a circular rod.

In certain embodiments, the first and second clamping plates each include a notched portion.

In some embodiments, the device includes two locking mechanism.

In other embodiments, the device can further include a safety harness worn by a user. The safety harness has a lanyard and a terminal attachment means for connecting to the hinge rod.

In another aspect of the instant invention, a method includes the steps of: securing a safety tie off device to a roof structure. The safety tie off device includes a plate. The plate has at least one spacer bar attached thereto. An anchor is connected to the plate and protrudes substantially perpendicular to the plate. A locking assembly has at least one knob. The at least one knob is connected to a threaded rod. The threaded rod engages a threaded fastener. The threaded fastener is connected to a locking plate; proof load testing the safety tie off device; and attaching a terminal attachment means of a safety harness being worn by a user to the anchor.

In some embodiments of this aspect, the terminal attachment means is a carabiner.

In certain embodiments, the roof structure is a cap and deck structure.

In some embodiments, the roof structure is a cap and deck structure including an ear.

In a particular embodiment, the safety tie off device further includes at least one slide plate. The at least one slide plate has at least one elongated aperture therein.

DESCRIPTION OF THE DRAWINGS

The drawings show embodiments of the disclosed subject matter for the purpose of illustrating the invention. However, it should be understood that the present application is not limited to the precise arrangements and instrumentalities shown in the drawings, wherein.

DETAILED DESCRIPTION OF THE PREFERRED EMBODIMENT

Figure 15:
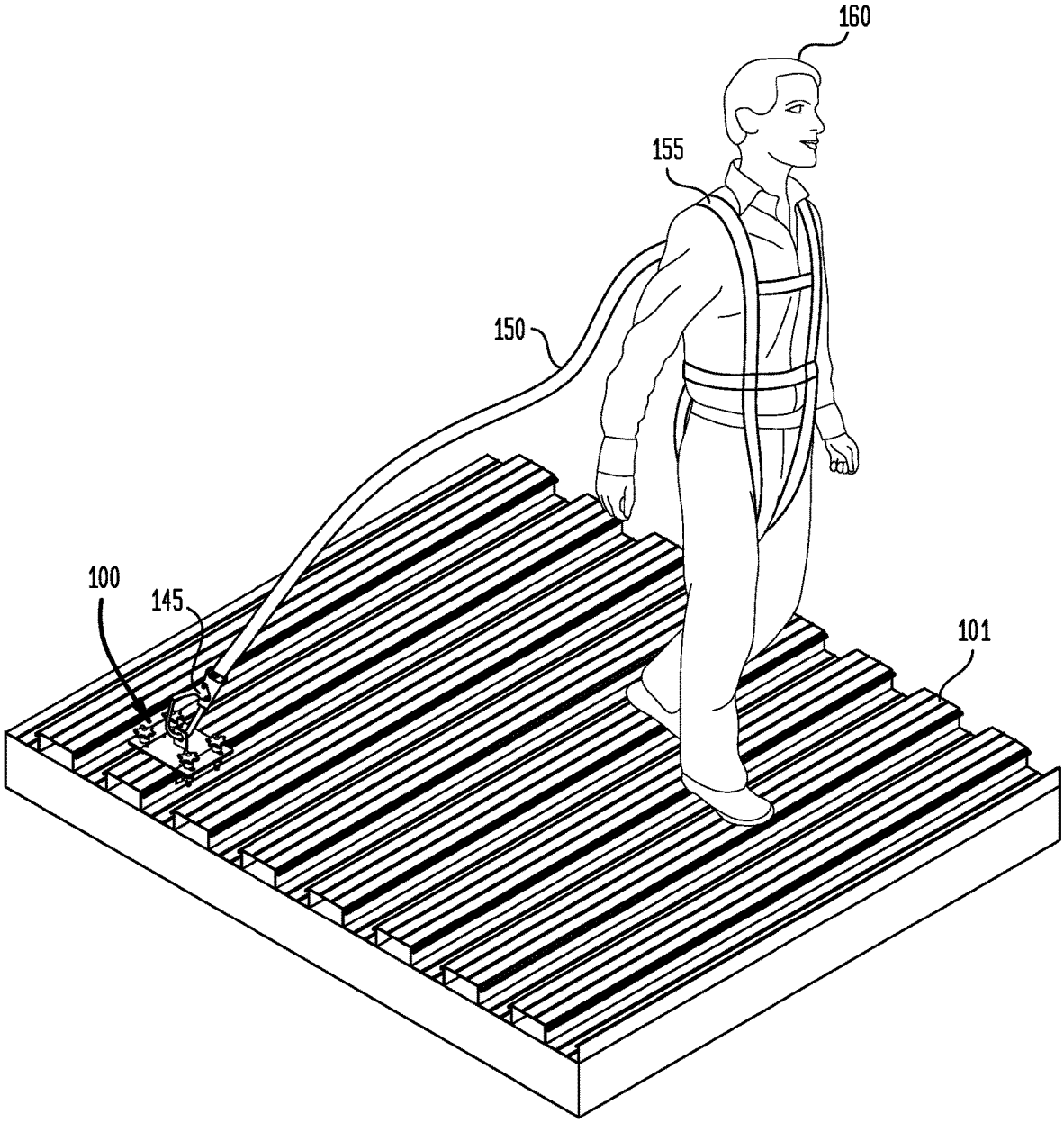
FIG. 15 is an isometric view of a user wearing a safety harness attached to the device of FIG. 1.

FIGS. 1-7 illustrate one exemplary non-limiting embodiment of a safety tie off device 100 installed on a roof structure 101. In this embodiment, the safety tie off device 100 includes a plate 2, which can be rectangular in shape or can be any convenient shape sized to fit a roof structure 101. The plate 2 includes an anchor 4. The anchor 4 can include a circular aperture 6 which can be used for attaching one more safety harness 155 worn by a user 160 as shown in FIG. 15. The anchor 4 can be welded to the plate 2 and can be substantially perpendicular thereto. The plate also includes longitudinal spacers 10 for precision installation as discussed herein.

The device 100 also includes knobs 8. The knobs 8 for this embodiment are star shaped to eliminate the risk of a harness 155 accidentally catching on the knobs 8 and potentially loosening the device 100 from a fixed position on a roof structure 101 as discussed herein. Other knob configurations are contemplated within the scope of the invention. It is important that the knobs 8 do not include any shape or configuration that could accidentally catch on a safety harness 150 thereby increasing the risk of accidental loosening.

The knobs 8 are attached to locking assemblies 12 using threaded rods 14. The knobs 8 include and internal threaded portion 8A. The knobs can also include an internal threaded aperture 8B for holding a set screw 8C. The set screw 8C can be used to lock the knobs 8 to the rods 14. The locking assembly 12 includes slide plates 20 which include elongated adjustment apertures 22. The locking plates 16 and the fasteners 18 connected or fused to form a rigid member. The locking plates 16 can be made to fit any particular angle to accommodate use on a variety of roof structures 101.

In use, the device 100 can be placed on deck and cap type roof structure or canopy assembly 101. The canopy assembly 101 includes a cap section 103 including an ear 105, and deck section 107. The deck 107 and cap 105 are fit together to form a lockable stable structure 101. The plate 2 is placed on the cap 103 such that spacers 10 straddle the cap 105. Next, the locking assemblies 12 can engage the cap 103 such that the ear 105 is frictionally engaged between the spacers 10, the plate 2 and the locking plates 16. By tightening knobs 8, rods 14 cause the locking assembly 12 to form a rigid, stable, detachable connection of the device to the roof or canopy structure 101. It is important to note that the locking plates 16 are configured to clamp under the ear 105 of the deck 107. This configuration allows the ear 105 to be sandwiched between spacer 10 and rod 14 of the locking assembly 12, thus forming a durable, strong, yet easily installable and releasable, mechanical lock between the device 100 and the cap and deck structure 101.

Once the device 100 is secured in place, it should be load tested to meet any specific safety requirements. When the device 100 is in place and certified ready for use, a safety harness 150 can be tied to the device 100 by engaging the aperture 6 of the anchor 4. Any safety harness 150 such as a full body harness can be adapted to attach to the anchor 4 for example, by using a lanyard and carabiner. Safety harnesses and method of attachment to a stable structure are well known the art. As such, the device can be fitted with any type of anchor 4, or an interchangeable anchor 4 in order to fit a wide variety of safety harnesses or known attachment methods. Once attached via a safety harness 150, a worker 160 can work freely without fear of falling or risk of injury from an untethered fall.

In another non-limiting exemplary embodiment, FIGS. 8-14 depict a soffit pan safety tie off device 200. The device includes a first clamping plate 40 and a second clamping plate 42. The clamping plates 40, 42 are connected with a hinge 44 having a rod 48. Each clamping plate 40, 42, includes a spacer plate 46. The clamping plates 40, 42 include through apertures 48 connected to a threaded rod 50 by a nut 52 on a first end 54 and connected to a handle 56 on a second end 58.

Figure 1:
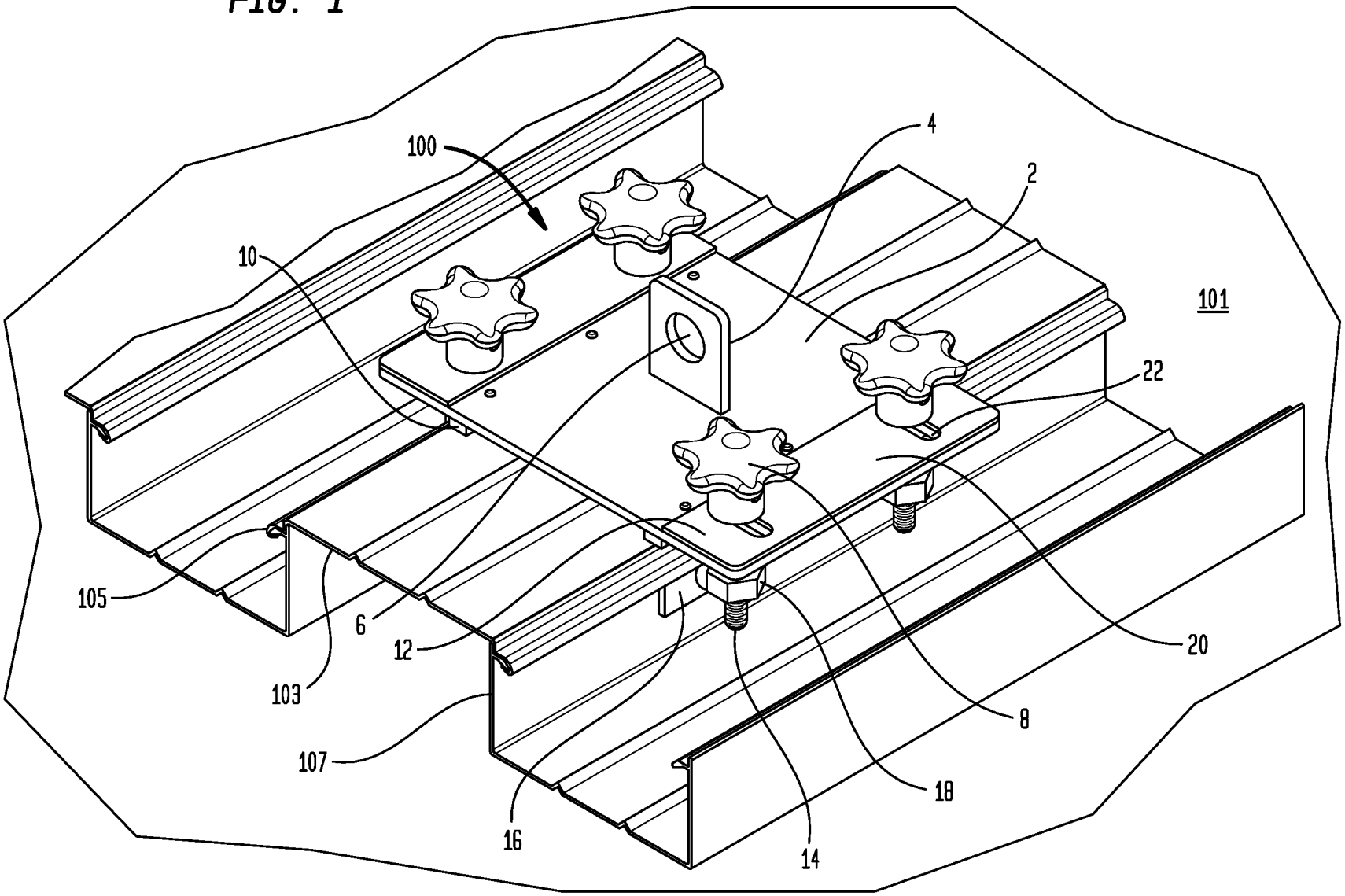
FIG. 1 is an isometric view of one embodiment on accordance with the present invention installed on a roof structure.
Figure 2:
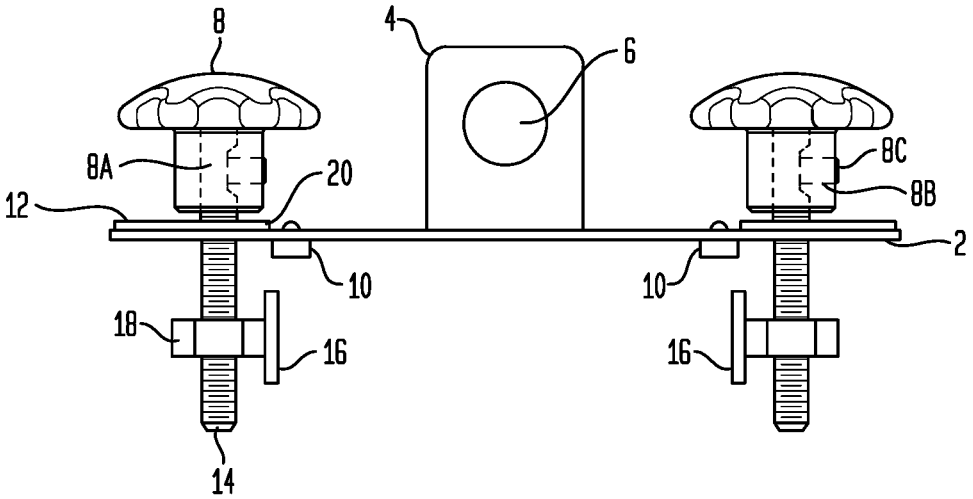
FIG. 2 is a side view of the device of FIG. 1 in accordance with the present invention.
Figure 3:
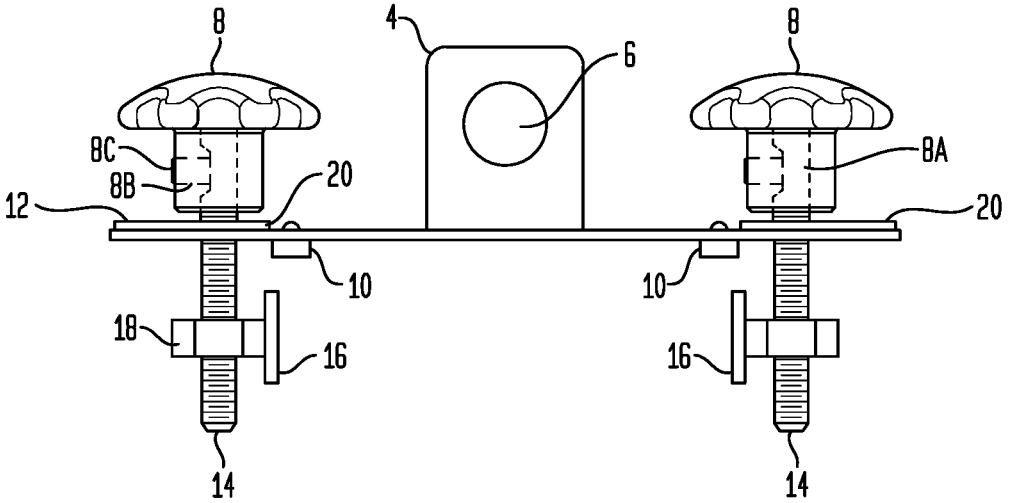
FIG. 3 is another side view of the device of FIG. 1 in accordance with the present invention.
Figure 4:
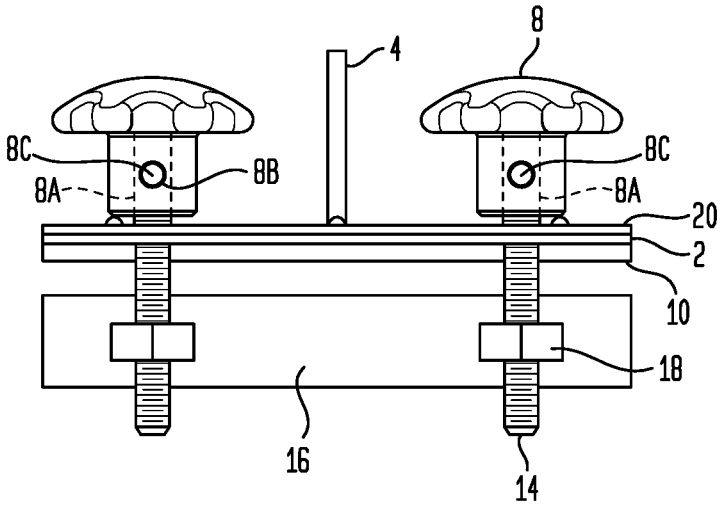
FIG. 4 is an orthogonal side view in accordance with the present invention.
Figure 5:
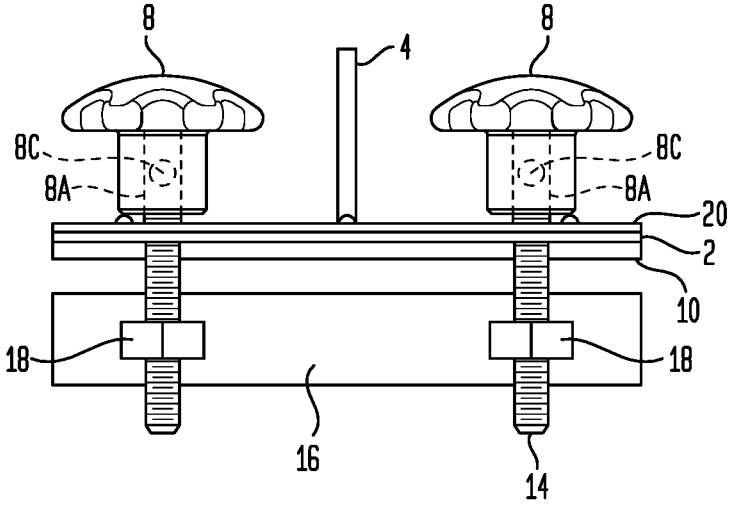
FIG. 5 is another orthogonal side view in accordance with the present invention.
Figure 6:
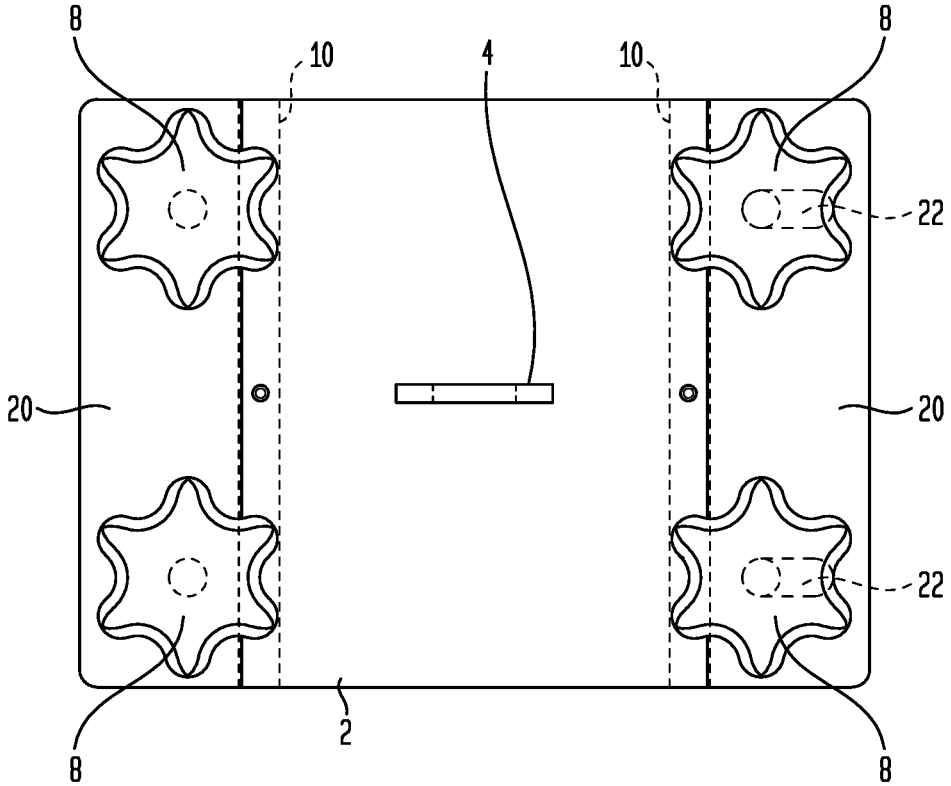
FIG. 6 is a top view in accordance with the present invention.
Figure 7:
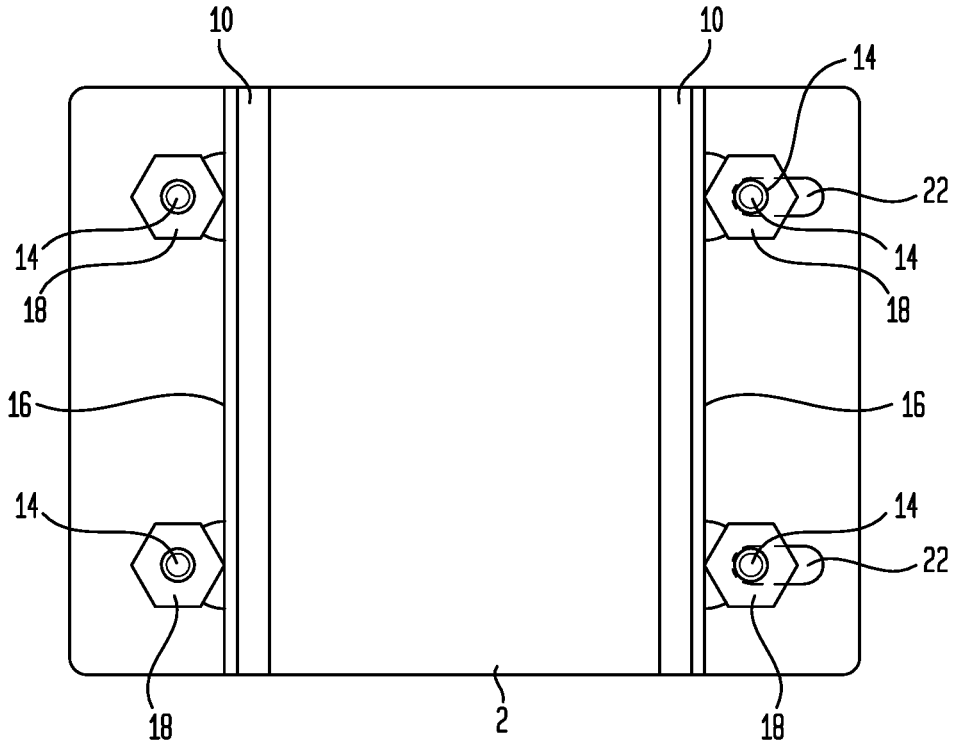
FIG. 7 is a bottom view in accordance with the present invention.
Figure 8:
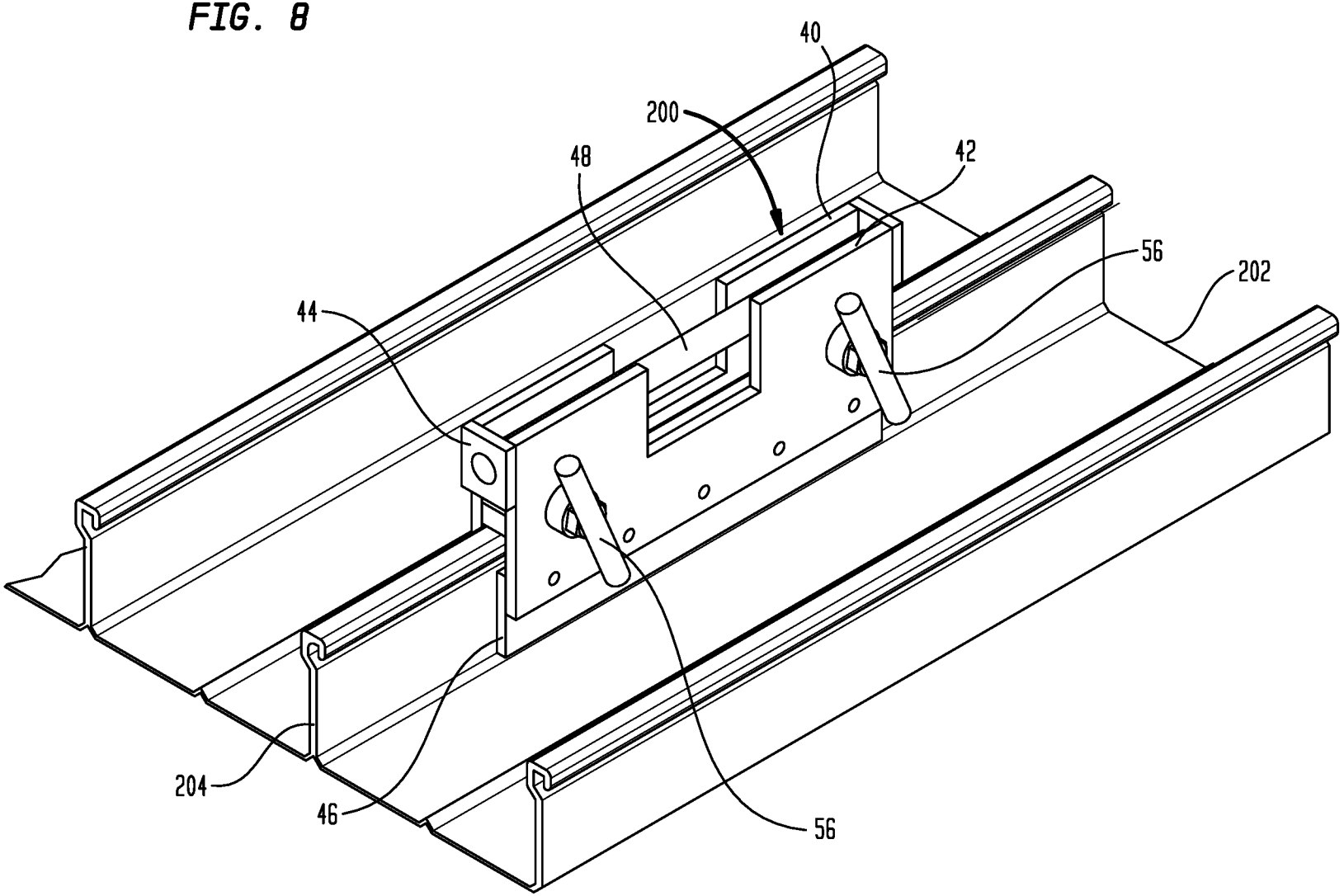
FIG. 8 is an isometric view of another embodiment on accordance with the present invention installed on a roof structure.
Figure 9:
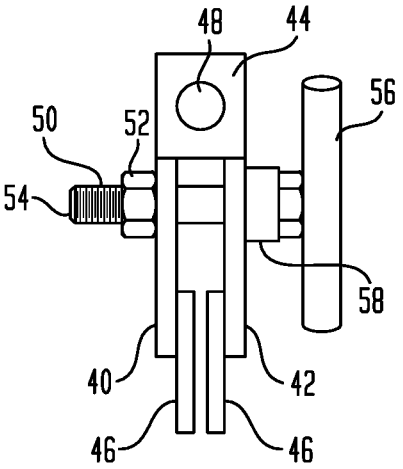
FIG. 9 is a side view of the device of FIG. 8 in accordance with the present invention.
Figure 10:
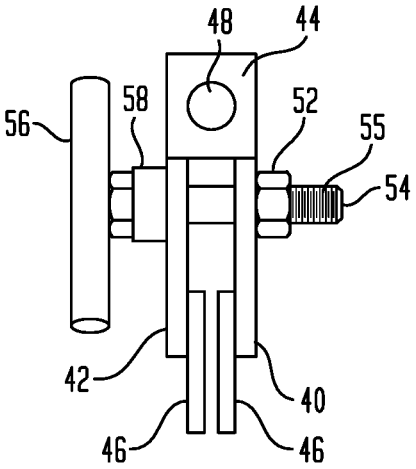
FIG. 10 is another side view of the device of FIG. 8 in accordance with the present invention.
Figure 11:
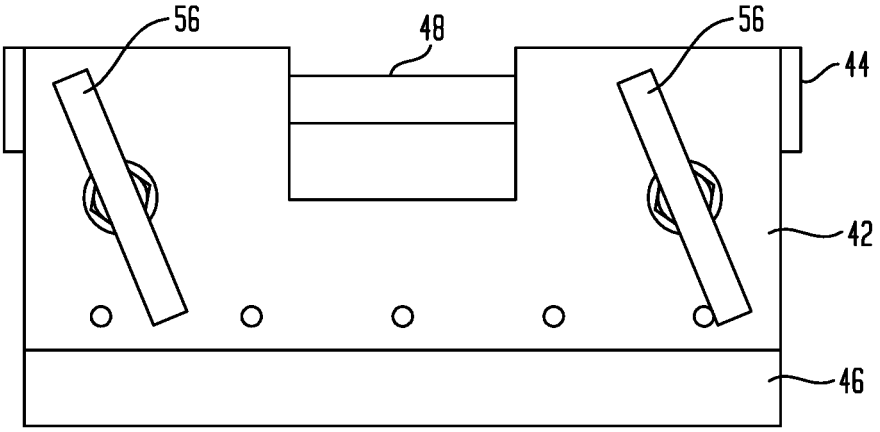
FIG. 11 is an orthogonal side view in accordance with the present invention.
Figure 12:
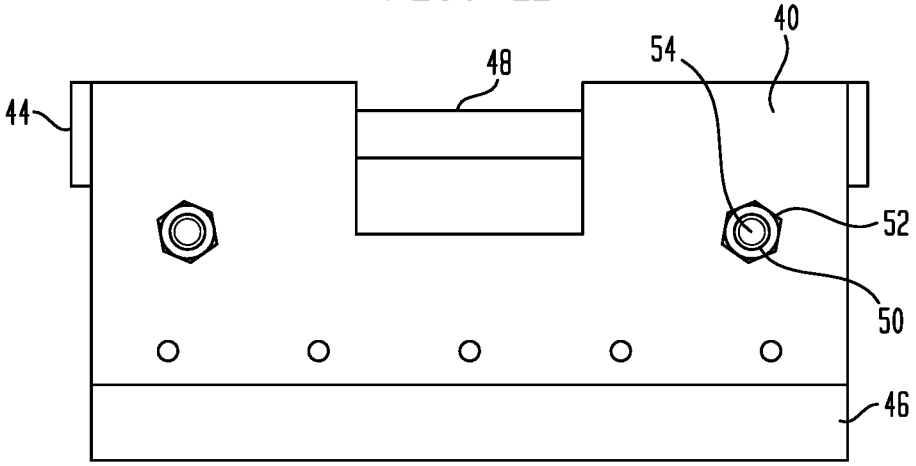
FIG. 12 is another orthogonal side view in accordance with the present invention.
Figure 13:
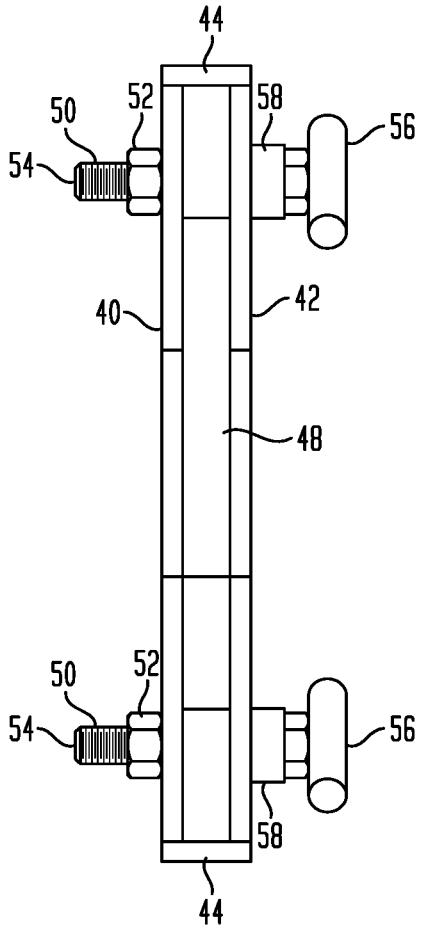
FIG. 13 is a top view in accordance with the present invention.
Figure 14:
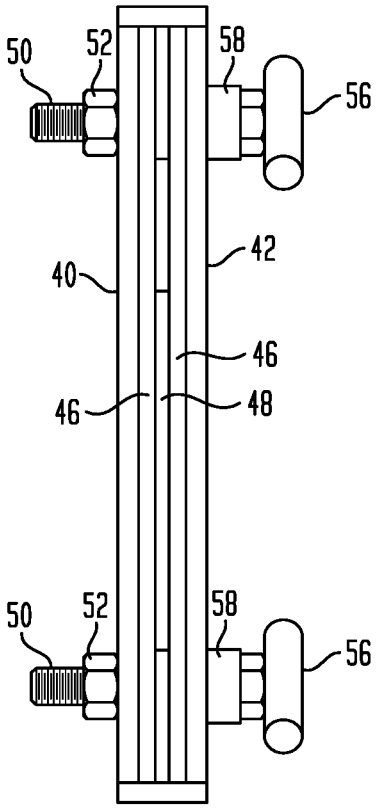
FIG. 14 is bottom view in accordance with the present invention.

Once in place on an existing soffit pan 202, the device 200 can be secured as shown in FIG. 8. By tightening the handles 56, the spacer plates 46 engage the vertical wall 204 of the soffit pan 202. The spacer plates 46 are configured so that there is a space between the clamping plates 40, 42 and the hinge 44 when the plates 40,42 are clamped together and frictionally engage the vertical wall 204 of a soffit pan 202 such that the hinge rod 48 can be used as a tie off anchor for attaching a safety harness. As discussed herein, any known safety harness or attachment means can be accommodated by the instant invention.

As shown in FIG. 15, a user 160 wearing a safety harness 155 having a lanyard 150 and a terminal attachment means such as a carabiner 145 tethered to a device 100, which is securely attached to a roof structure 101 as discussed herein. The carabiner can be attached or detached by engaging or disengaging the aperture 6 of the anchor 4.

Although the present invention has been disclosed and described with reference to certain embodiments thereof, it should be noted that other variations and modifications may be made, and it is intended that the following claims cover the variations and modifications within the true scope of the invention.

What is claimed is:

1. A safety tie off device comprising:

a plate, the plate including at least one longitudinal spacer bar attached to a first face of the plate and located in between a central portion of the plate and a threaded rod, and an anchor connected to a second face of the plate opposing the first face of the plate and protruding substantially perpendicular to the plate, the anchor including an aperture therein; and a locking assembly, the locking assembly including at least one knob, the at least one knob being connected to the threaded rod, the threaded rod engaging a threaded fastener, the threaded fastener being connected to a locking plate, thereby forming a rigid member, the locking assembly including at least one slide plate disposed longitudinally on the second face of the plate, the at least one slide plate includes an elongated adjustment aperture, the threaded rod protruding through the elongated adjustment aperture and through the threaded fastener, thus allowing the locking plate and the threaded fastener to be engaged or disengaged, wherein the safety tie off device is configured to attach to a cap and deck structure, thereby forming a detachable stable safety tie off device without damaging or penetrating the cap and deck structure.

2. The safety tie off device of claim 1, wherein the anchor includes a circular aperture.

3. The safety tie off device of claim 1, wherein the at least one knob is star shaped.

4. The safety tie off device of claim 1, wherein the cap and deck structure includes an ear.

5. The safety tie off device of claim 1, wherein the at least one knob is four knobs.

6. The safety tie off device of claim 1, wherein the at least one spacer bar is two spacer bars.

7. The safety tie off device of claim 1, wherein the at least one slide plate is two slide plates, each of the two slide plates having two elongated apertures therein.

8. The safety tie off device of claim 1, wherein locking assembly includes four knobs, each of the four knobs being connected a first, a second, a third, and a fourth threaded rod, respectively, each threaded rod engaging a first, a second, a third, and a fourth threaded fastener, respectively, the first and second threaded fastener being connected to a first locking plate, the third and fourth threaded fastener being connected to a second locking plate.

9. The safety tie off device of claim 1, further including a safety harness, the safety harness including a lanyard and a terminal attachment means for connecting to the anchor, wherein the safety harness is adapted to be worn by a user to provide a detachable safe connection to the cap and deck structure.

* * * * *